US007882979B2

(12) United States Patent
Rossetti

(10) Patent No.: US 7,882,979 B2
(45) Date of Patent: Feb. 8, 2011

(54) COMBINATION DIP AND CAKE AND PUNCH BOWL

(76) Inventor: Line A. Rossetti, 225 Chicago Ave., Valparaiso, FL (US) 32580

( * ) Notice: Subject to any disclaimer, the term of this patent is extended or adjusted under 35 U.S.C. 154(b) by 0 days.

(21) Appl. No.: 11/539,785

(22) Filed: Oct. 9, 2006

(65) Prior Publication Data

US 2007/0080161 A1 Apr. 12, 2007

Related U.S. Application Data

(63) Continuation of application No. 10/874,858, filed on Jun. 24, 2004, now Pat. No. 7,118,004.

(51) Int. Cl.
*A47G 19/00* (2006.01)
*B65D 25/24* (2006.01)

(52) U.S. Cl. ..... 220/575; 220/23.86; 220/630

(58) Field of Classification Search ..... 220/23.86, 220/212, 575, 574, 630, 380; D7/610, 327
See application file for complete search history.

(56) References Cited

U.S. PATENT DOCUMENTS

| | | | | |
|---|---|---|---|---|
| 512,109 | A | 1/1894 | Hinman | |
| 943,162 | A | 10/1909 | Schlisinger | |
| 1,665,289 | A | 4/1928 | Weaver | |
| 2,719,413 | A * | 10/1955 | Panzer | 220/575 |
| 3,006,705 | A | 10/1961 | Williams et al. | |
| D195,046 | S | 4/1963 | Swett | |
| 3,170,416 | A | 2/1965 | Uerlich | |
| D208,097 | S | 7/1967 | Henn | |
| 3,369,687 | A * | 2/1968 | Walls | 215/10 |
| 3,526,335 | A * | 9/1970 | Swett et al. | 220/630 |
| 3,576,113 | A | 4/1971 | Swett | |
| 3,834,437 | A | 9/1974 | Swett et al. | |
| 4,600,253 | A | 7/1986 | Pongsengsook | |
| D304,658 | S | 11/1989 | Mattei | |
| 5,180,079 | A | 1/1993 | Jeng | |
| D384,554 | S | 10/1997 | An Cona et al. | |
| 5,692,617 | A | 12/1997 | Adams | |
| 6,138,860 | A * | 10/2000 | Comeaux | 220/574 |
| 6,237,881 | B1 | 5/2001 | Levesque | |
| 6,338,417 | B1 | 1/2002 | Ferraro | |
| 6,474,494 | B1 | 11/2002 | Miller | |
| 6,796,430 | B2 * | 9/2004 | Mercier et al. | 206/505 |
| 2005/0077303 | A1 * | 4/2005 | Minner et al. | 220/574 |

* cited by examiner

*Primary Examiner*—Anthony Stashick
*Assistant Examiner*—Shawn M Braden
(74) *Attorney, Agent, or Firm*—Michael L. Greenberg, Esq.; Greenberg & Lieberman, LLC

(57) ABSTRACT

A combination dip and cake holder and punch bowl is readily configurable between any of three configurations. A platter member has a base with a female receiver, while a first type of receptacle has an extension that is receivable within the receiver so that when the first receptacle faces upwardly, a dip holder is formed. A second receptacle also has an extension that is receivable within the first extension of the first receptacle in order to form a punch bowl. When the first receptacle rests on its rim and the platter member receives the receptacle's extension, the device acts as a cake holder with the second receptacle being used as a cover that sits on the platter member.

3 Claims, 3 Drawing Sheets

COMBINATION DIP AND CAKE AND PUNCH BOWL

This is a continuation of application Ser. No. 10/874,858, priority claimed.

BACKGROUND OF THE INVENTION

1. Field of the Invention

The present invention relates to a device that can be configured to hold dip, punch or a cake or similar items to these.

2. Background of the Prior Art

One of the problems with home entertaining is the need to have sufficient serving trays and receptacles on hand to hold the various items to be served. While a hostess may use paper servers or everyday dishes, such implements are typically satisfactory for only the most informal events, such as close family and friends. When more elegant affairs are on tap, more elegant service dishes are called for. Many hosts and hostesses buy various serving dishes and bowls for the more fancy affairs that are thrown, however, this poses a problem. Typically, such service items, by being relatively fancy and elegant, tend to be reserved for the more fancy social affairs being hosted. As such parties are occasional affairs for most, and as each service item occupies a relatively large amount of real estate, storage of such items between affairs can be problematic for all but the grandest of houses.

In order to combat this problem, combination dishes have been proposed wherein a single service item serves more than one function, thereby lessening the storage space requirement for the hostess. The problems with these prior art devices is that some such devices are relatively cumbersome and awkward to assemble making use of such devices less than desirable. Items that are relatively easier to assemble are made from plastic or similar material and are thus less than ideal for more formal affairs.

Accordingly, there exists a need in the art for a single device that can have multiple uses for food service at an affair so that the device has versatility for a given event and so that the device occupies a reasonable amount of real estate when not in use. Such a device must be easy to assemble and to reconfigure for additional uses and must be able to be made from materials that are suitable for more formal affairs.

SUMMARY OF THE INVENTION

The combination dip and cake holder and punch bowl of the present invention addresses the aforementioned needs in the art. The combination dip and cake holder and punch bowl is a device that can be configured to hold chips and dip, or punch, or a cake with a cover (or other similar items) making the present invention very versatile while conserving storage space when not in use. The combination dip and cake holder and punch bowl is relatively easy to configure to any one of its main three uses and is relatively easy to reconfigure to another use after the first configuration. The combination dip and cake holder and punch bowl can be made from many materials, including glass and lead crystal so that its presence at a fancy affair is not out of place.

The combination dip and cake holder and punch bowl of the present invention is comprised of a platter member that has an upper surface and a lower surface with the lower surface having a base with a female receiver. A first receptacle has a first outer rim and a first extension such that the first extension is removably receivable within the female receiver. A second receptacle has a second outer rim and a second extension such that the second extension is removably receivable within the first extension. When the first receptacle has its first outer rim resting on a surface and the female receiver of the base of the platter member receives the first extension, the upper surface of the platter member acts as a holder (for cakes and such) and the second outer rim of the second receptacle rests on the upper surface of the platter member to act as a cover, and such that when the platter member rests on a surface such that the base extends upwardly and the first extension of the first receptacle is received within the female receiver, the first receptacle is usable as a first bowl (such as a dip holder) and such that when the second extension of the second receptacle is received within the first extension of the first receptacle that is received within the female receiver of the platter member, the second receptacle is usable as a second bowl (such as a punch bowl). The shape of the male portion of the first extension corresponds to the shape of the female receiver while the shape of the second extension corresponds to the female portion shape of the first extension. The first extension and the second extension may each comprise a central prong surrounded by a plurality of outer prongs which are shorter than the central prong. A plurality of parallel outer rings encompass an outer surface of the base of the platter member. A skirt encompasses an outer periphery of the platter member, the skirt extends upwardly from the upper surface and downwardly from the lower surface of the platter member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
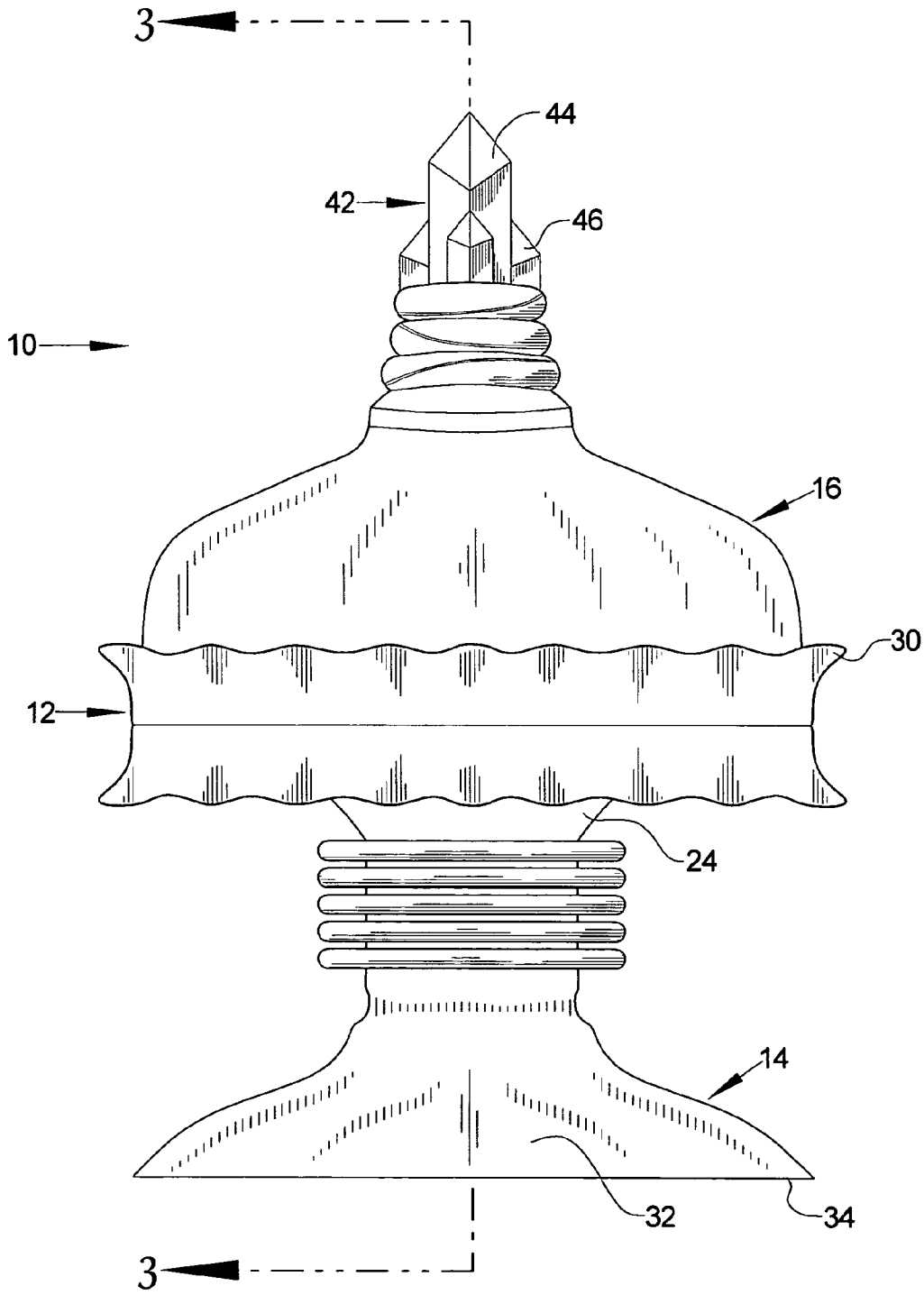
FIG. 1 is a side elevation view of the combination dip and cake holder and punch bowl configured as a cake holder.
Figure 2:
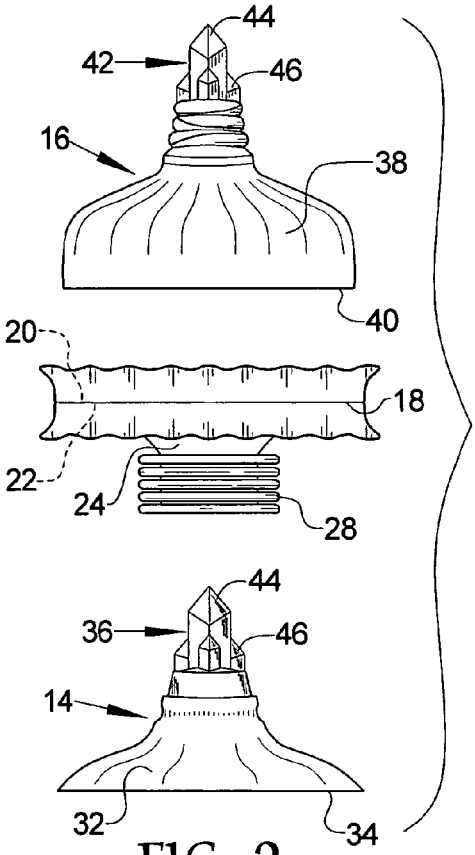
FIG. 2 is an exploded side elevation view of the combination dip and cake holder and punch bowl as configured in FIG. 1.
Figure 3:
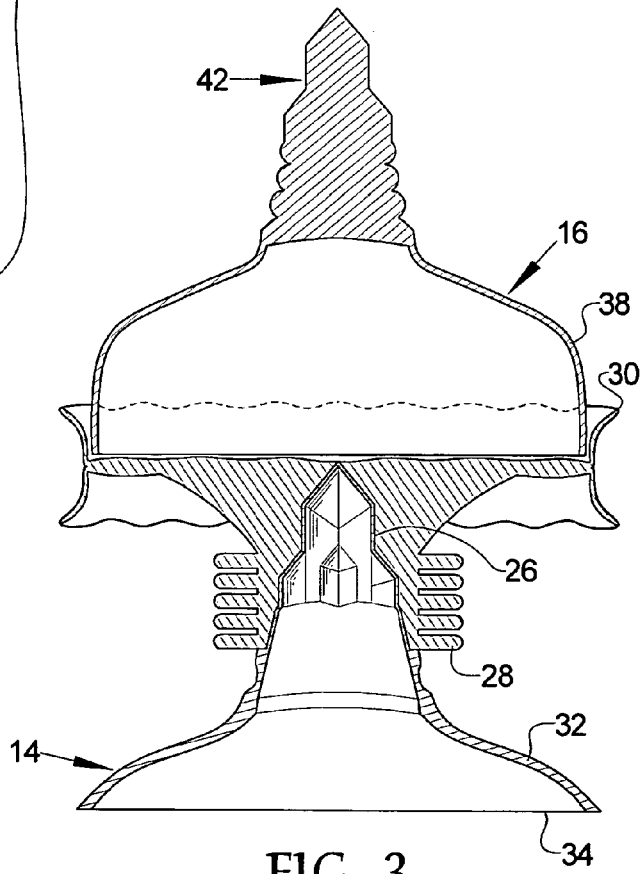
FIG. 3 is a sectioned view of the combination dip and cake holder and punch bowl taken along line 3-3 in FIG. 1.

Referring now to the drawings, it is seen that the combination dip and cake holder and punch bowl of the present invention, generally denoted by reference numeral 10, is comprised of three main units, a platter member 12, a first receptacle 14, and a second receptacle 16. As seen, the platter member 12 is comprised of a relatively flat plate 18 that has an upper surface 20 and a lower surface 22. A base 24 extends downwardly from the lower surface 22 of the plate 18 and has a female receiver 26 therein. A series of parallel rings 28 or other decorative items encompasses an outer surface of the base 24 of the platter member 12. A skirt 30 encompasses an outer periphery of the plate 18 and extends above the upper surface 20 of the plate 18 as well as below the lower surface 22 of the plate 18. As also seen, the first receptacle 14 is comprised of a first main bowl 32 for holding liquids and other items therein with a first outer rim 34 located thereon. A first extension 36 extends downwardly from the first main bowl 32 in a direction opposite to that of the first outer ring 34. The first extension 36 acts as both a male member (its outer surface) that is received by the receiver 26 of the base 24 of the platter member 12 and as a female member (its inner portion) that receives the extension, described infra, of the second receptacle 16. As further seen, the second receptacle 16 is comprised of a second main bowl 38 for holding liquids and other items therein with a second outer rim 40 located thereon. A second extension 42 extends downwardly from the second main bowl 38 in a direction opposite to that of the second outer ring 40. The first main bowl 32 of the first receptacle 14 is generally volumetrically smaller than the second main bowl 38 of the second receptacle 16.

As seen, the first extension 36 (both the male and female portions) of the first receptacle 14 and the second extension 42 of the second receptacle 16 may be substantially similar in shape. Each extension 36 and 42 has a main central prong 44 surrounded by a plurality of outer prongs 46 that are shorter than the central prong 44. The shape of the male portion of the first extension 36 corresponds to the shape of the female receiver 26 of the platter member 12 such that the first extension 36 is removably receivable within the female receiver 26 and once so received, the first extension 36 fits snugly and securely within the female receiver 26. The shape of the second extension 42 corresponds to the shape of the female portion of the first extension 36 of the first receptacle 14 such that the second extension 42 is removably receivable within the first extension 36 and once so received, the second extension 42 fits snugly and securely within the first extension 36. By using a multi-prong 44 and 46 design for each extension 36 and 42 or similar design that avoids the use of cylindrical extensions, once the first extension 36 is received within the female receiver 26, or the second extension 42 is received within the first extension 36, the particular extension 36 or 42 is not free to spin or rotate, thereby adding stability to the particular configuration that is assembled.

Figure 4:
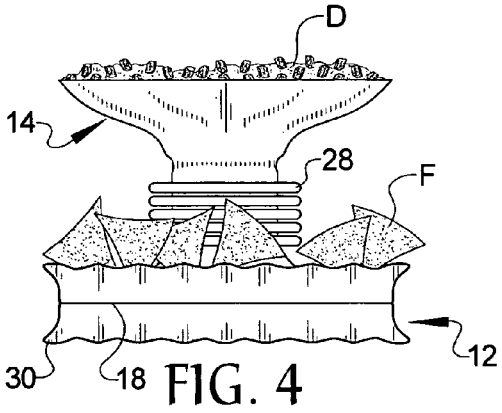
FIG. 4 is a side elevation view of the combination dip and cake holder and punch bowl configured as a dip holder.
Figure 5:
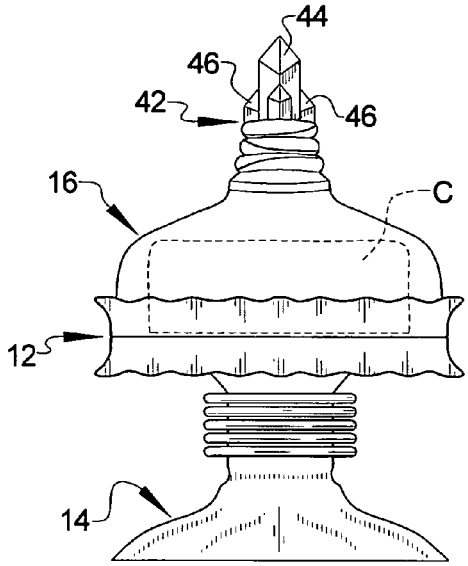
FIG. 5 is a side elevation view of the combination dip and cake holder and punch bowl configured as in FIG. 1 with a cake thereon.

In operation, the device 10 can be used as a dip D holder, a cake C holder, or a punch P holder. In the dip D holder, the platter member 12 is placed upon a surface such that skirt 30 makes actual contact with the surface and the base 24 faces upwardly away from the surface upon which the platter member 12 is resting. The first receptacle 14 is positioned such that its first extension 36 is received within the female receiver 26 of the base 24 of the platter member 12, as best illustrated in FIG. 4. The first main bowl 32 of the first receptacle 14 can be filled with dip D or other similar products (candy, pretzels, champagne, etc.). As the first extension 36 is hollow in order to act as a female receiver for the second extension 42 of the second receptacle 16, the dip D or other items placed into the first main bowl 32 also drop into the first extension 36 thereby increasing the overall capacity of the first receptacle 14. The lower surface 22 of the plate 18 of the platter member 12 can also be used to hold items such as chips F for the dip D held by the first receptacle 14. The skirt 30 helps keep these secondary items F on the plate 18.

Figure 6:
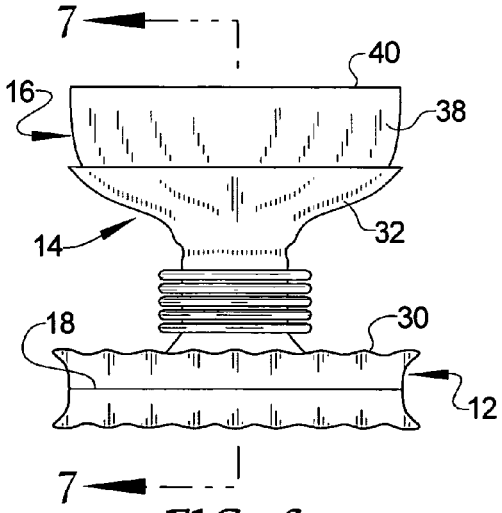
FIG. 6 is a side elevation view-of the combination dip and cake holder and punch bowl configured as a punch bowl.
Figure 7:
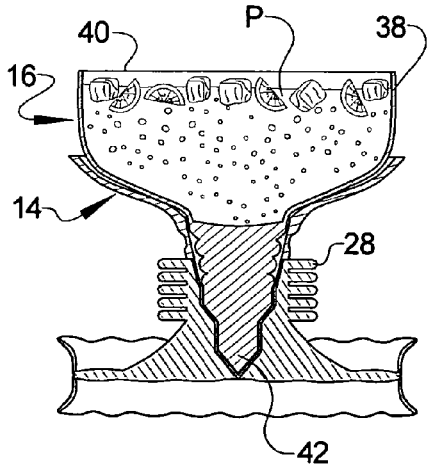
FIG. 7 is a sectioned view of the combination dip and cake holder and punch bowl taken along line 7-7 in FIG. 6.

If a punch bowl configuration is desired, the device 10 is configured as above for a dip holder, but instead of filling the first receptacle 14 with a product, the second receptacle 16 is positioned such that its second extension 42 is received within the first extension 36 of the first receptacle 14, as best illustrated in FIGS. 6 and 7. In this configuration, the second main bowl 38 of the second receptacle 16 sits, at least partially, within the first main bowl 32 of the first receptacle 14. The second receptacle 16 can be filled with a desired product such as punch P etc.

If a cake holder configuration is desired, the first receptacle 14 is positioned such that it rests on its outer rim 34. The female receiver 26 of the base 24 of the platter member 12 receives the upwardly extending first extension 36 of the first receptacle 14. The cake C or other item to be held sits on the upper surface 20 of the plate 18. The second receptacle 16 can be positioned such that its second outer rim 40 sits on the upper surface 20 of the plate 18 in order to act as a cover for the cake C. The skirt helps keep the second receptacle 16 in place in covering relationship with the cake C. The second extension 42 of the second receptacle 16 acts as a handle such that when access to the cake C is desired, the cover (the second receptacle 16) is grasped by its handle (the second extension 42) and removed and thereafter replaced as needed. An appropriate design may be placed on the outer surface of the second extension 42 to help facilitate handling of the second receptacle 16 via the second extension 42.

Each component 12, 14, and 16 of the device 10 can be made from any appropriate sturdy material, such as plastic, glass, including lead crystal, metal, etc. Each component 12, 14, and 16, can be made of monolithic construction or from two or more parts appropriately attached. Configuration to any of the three configurations—dip holder, punchbowl, or cake holder—is relatively straightforward and once the device 10 is so configured, reconfiguring to a different configuration is also relatively simple and straight forward. The combination dip and cake holder and punch bowl 10 can be stored as a single assembled unit either as a punch bowl or cake holder with the cover (second receptacle 16) thereon for compactness of storage.

While the invention has been particularly shown and described with reference to an embodiment thereof, it will be appreciated by those skilled in the art that various changes in form and detail may be made without departing from the spirit and scope of the invention.

I claim:

1. A holder, readily configurable between any of three configurations, comprising:

a first configuration, comprising:

a second receptacle with a second extension that is centrally positioned, closed-ended and extends above and from said second receptacle, said second receptacle on top of a platter member;

said platter member having a generally planar top surface and a base extending down from said generally planar top surface, said base having a receiver opening away from said generally planar top surface;

a first receptacle, having a different shape than said second receptacle, said first receptacle having a first extension, said first receptacle under said platter member, and said first extension fitted into said receiver of said platter member;

a second configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member; and a third configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member;

said second receptacle, having a different shape than said first receptacle, said second receptacle inverted compared with said first configuration, said second extension at a bottom of said second receptacle, said second extension fitted into said first extension of said first receptacle.

2. A holder, readily configurable between any of three configurations, comprising:

a first configuration, comprising:

a second receptacle with a second extension that is centrally positioned, closed-ended and extends above and from said second receptacle, said second receptacle on top of a platter member;

said platter member having a generally planar top surface and a base extending down from said generally planar top surface, said base having a receiver opening away from said generally planar top surface;

a first receptacle, having a different shape than said second receptacle, said first receptacle having a first extension that is centrally positioned and closed-ended, said first receptacle under said platter member, and said first extension fitted into said receiver of said platter member;

a second configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member; and a third configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member;

said second receptacle, having a different shape than said first receptacle, said second receptacle inverted compared with said first configuration, said second extension at a bottom of said second receptacle, said second extension fitted into said first extension of said first receptacle.

3. A holder, readily configurable between any of three configurations, comprising:

a first configuration, comprising:

a second receptacle with a second extending above and from said second receptacle, said second receptacle on top of a platter member;

said platter member having a generally planar top surface and a base extending down from said generally planar top surface, said base having a receiver opening away from said generally planar top surface;

a first receptacle, having a different shape than said second receptacle, said first receptacle having a first extension that is centrally positioned and closed-ended, said first receptacle under said platter member, and said first extension fitted into said receiver of said platter member;

a second configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member; and a third configuration, comprising:

said platter member inverted compared with said first configuration, with said generally planar top surface facing downward and said base facing upward;

said first receptacle inverted compared with said first configuration, said first receptacle on top of said platter member, said first extension fitted into said receiver of said platter member;

said second receptacle, having a different shape than said first receptacle, said second receptacle inverted compared with said first configuration, said second extension at a bottom of said second receptacle, said second extension fitted into said first extension of said first receptacle.

* * * * *